US005497550A

United States Patent [19]

Trotta et al.

[11] Patent Number: 5,497,550

[45] Date of Patent: Mar. 12, 1996

[54] SHAVING SYSTEM

[75] Inventors: Robert A. Trotta, Pembroke; Steve S. Hahn, Wellesley; John Madeira, Assonet; Chong-ping P. Chou, Lexington, all of Mass.; Lamar E. Brooks, North Providence, R.I.

[73] Assignee: The Gillette Company, Boston, Mass.

[21] Appl. No.: 192,034

[22] Filed: Feb. 3, 1994

Related U.S. Application Data

[63] Continuation-in-part of Ser. No. 793,027, Nov. 15, 1991, abandoned.

[51] Int. Cl.[6] ..... B26B 21/06

[52] U.S. Cl. ..... 30/50; 30/346.53; 30/346.55

[58] Field of Search ..... 30/50, 346.53, 30/346.54, 350, 346.55; 204/192.3

[56] References Cited

U.S. PATENT DOCUMENTS

| | | | |
|---|---|---|---|
| Re. 30,106 | 10/1979 | Polk et al. . | |
| 3,501,334 | 3/1970 | Flaherty . | |
| 3,652,443 | 3/1972 | Fish et al. . | |
| 3,761,372 | 9/1973 | Sastri | 30/346.55 |
| 3,786,563 | 1/1974 | Dorion Jr., et al. . | |
| 3,829,969 | 8/1974 | Fischbein et al. . | |
| 3,838,512 | 10/1974 | Sanderson . | |
| 3,900,636 | 8/1975 | Curry et al. . | |
| 3,961,103 | 6/1976 | Aisenberg . | |
| 4,069,580 | 1/1978 | Cartwright et al. | 30/47 |
| 4,146,958 | 4/1979 | Chen et al. . | |
| 4,282,650 | 8/1981 | Trotta . | |
| 4,345,374 | 8/1982 | Jacobson . | |
| 4,416,912 | 11/1983 | Bache . | |
| 4,434,188 | 2/1984 | Kamo et al. . | |
| 4,470,895 | 9/1984 | Coad et al. . | |
| 4,486,286 | 12/1984 | Lewin et al. . | |
| 4,490,229 | 12/1984 | Mirtich et al. . | |
| 4,504,519 | 3/1985 | Zelez . | |
| 4,586,255 | 5/1986 | Jacobson | 30/41 |
| 4,720,918 | 1/1988 | Curry et al. | 30/346.55 |
| 4,767,517 | 8/1988 | Hiraki et al. . | |
| 4,816,286 | 3/1989 | Hirose . | |
| 4,816,291 | 3/1989 | Desphandey et al. . | |
| 4,822,466 | 4/1989 | Rabalais et al. . | |
| 4,842,945 | 6/1989 | Ito et al. . | |
| 4,844,785 | 7/1989 | Kitabatake et al. . | |
| 4,849,290 | 7/1989 | Fujimori et al. . | |
| 4,871,434 | 10/1989 | Munz et al. . | |
| 4,884,476 | 12/1989 | Okuzumi et al. . | |
| 4,902,535 | 2/1990 | Garg et al. . | |
| 4,933,058 | 6/1990 | Bache et al. . | |
| 4,940,180 | 7/1990 | Martell . | |
| 4,973,388 | 11/1990 | Francois et al. . | |
| 4,988,421 | 1/1991 | Drawl et al. . | |
| 5,164,051 | 11/1992 | Komaki et al. . | |
| 5,190,631 | 3/1993 | Windischmann et al. . | |
| 5,232,568 | 8/1993 | Parent et al. | 30/346.53 |
| 5,234,561 | 8/1993 | Randhawa et al. . | |

FOREIGN PATENT DOCUMENTS

| | | |
|---|---|---|
| WO/90/03455 | 4/1990 | WIPO . |
| WO93/00204 | 1/1993 | WIPO . |

*Primary Examiner*—Scott A. Smith
*Attorney, Agent, or Firm*—Fish & Richardson

[57] ABSTRACT

A shaving system with a blade member with a cutting edge of wedge shape that is defined by main facets with an included facet angle in the range of 10°–17° in the region forty micrometers from the cutting edge. The blade is mounted between leading and trailing skin-engaging surfaces so that the blade tangent angle is less than 20° and the interior main facet of the blade is disposed at an angle of more than 150° to a reference line that extends from the cutting edge of the blade to the skin-engaging point next forward of the blade edge.

10 Claims, 1 Drawing Sheet

SHAVING SYSTEM

This is a continuation-in-part of Application Ser. No. 07/793,027, filed Nov. 15, 1991, now abandoned and entitled SHAVING SYSTEM.

This invention relates to shaving systems, and more particularly to shaving systems of the wet shave type.

A shaving system of the wet shave type includes at least one blade structure and a surface for engaging the user's skin adjacent the blade edge or edges. Typically, the shaving system includes a leading skin-engaging surface (forward of the cutting edge of the blade structure) and a trailing skin-engaging surface (rearwardly of the blade unit structure). The leading skin-engaging surface may be referred to as a guard surface and the trailing skin-engaging surface may be referred to as a cap surface. The skin-engaging surfaces cooperate with the blade edge or edges and have one or more functions such as definition of shaving geometry, tensioning of skin in the region to be shaved, and/or delivery of shaving aid material to the skin surface during the shaving stroke. The shaving system may be of the disposable cartridge type adapted for coupling to and uncoupling from a razor handle or may be integral with a handle so that the complete razor is discarded as a unit when the blade or blades become dulled.

A razor blade typically is formed of a suitable substrate material such as metal or ceramic, and an edge of wedge-shape configuration is formed with an ultimate tip that has a radius of less than about 1,000 angstroms. During use, the razor blonde typically is held in a razor at an angle of approximately 25° to the skin surface and the blade is moved over the skin surface so that when the edge encounters a beard hair, it enters and severs that hair by progressive penetration, aided by a wedging action. It is believed that the cut portion of the hair (which on average is about one hundred micrometers in diameter) remains pressed in contact with the blade facets remote from the facial skin surface from a penetration up to only about half the hair diameter. Beyond this, the hair can bend away from the blade to relieve the wedging forces. The resistance to penetration through reaction between hair and blade facets therefore occurs only over about the first sixty micrometers of the blade tip back from the edge, and the geometry of the blade tip in this region may be regarded as being the most important from the cutting point of view. It is believed that a reduction in the included angle of the facets would correspondingly reduce resistance to continued penetration of the blade tip into the hair. However, reduction of the included facet angle tends to reduce the strength of the blade tip, so that that tip tends to deform plastically (or fracture in a brittle fashion) depending on the mechanical properties of the material from which it is made and so sustains permanent damage, which impairs it subsequent cutting performance, i.e., the edge becomes "blunt" or "dull". As shaving action is severe and blade edge damage frequently results, and to enhance shavability, a layer of supplemental coating material may be employed to provide characteristics such as improved shavability, improved hardness, increased edge strength, durability and/or corrosion resistance while not adversely affecting the geometry and effectiveness of the shaving edge.

It has been discovered that the shavability of a shaving system in which certain geometrical relationships are observed provides superior shaving characteristics. Such a shaving system employs a blade member with a cutting edge of wedge shape that is defined by main facets with an included facet angle in the range of 10°–17° in the region forty micrometers from the cutting edge. "Blade tangent angle" (BTA) is defined as the angle between the bisector of the included angle that defines the cutting edge of the blade and a reference line that extends from that cutting edge to a point tangent to the skin-engaging surface immediate forward of that cutting edge. The blade is mounted between leading and trailing skin-engaging surfaces so that the blade tangent angle is less than 20° and the interior main facet of the blade is disposed at an angle of more than 150° to a reference line that extends from the cutting edge of the blade to the skin-engaging point next forward of the blade edge.

A plural cutting edge shaving system in accordance with preferred embodiments of the invention includes two cutting edges disposed parallel to one another and in spaced relation to provide leading and following cutting edges so that both cutting edges are successively active with respect to the hair elements being cut during a single shaving stroke. The cutting edges are supported in spaced parallel relationship to one another between guard structure disposed forwardly of the cutting edges and cap structure disposed rearwardly of the cutting edges. The facet bisector of each blade is parallel to the planar body of the blade member, the blade tangent angle of each blade member is less than 20° and each interior main facet is disposed at an angle of more than 150° to its reference line. In particular embodiments, the leading skin engaging surface is a guard member and the body structure includes spaced opposed pairs of slots for guiding movement of the guard and two blade members along predetermined paths which, in particular embodiments, are parallel straight line paths for independent resilient movement of the guard and two blade members with respect to the body structure. The trailing skin-engaging surface includes shaving aid material for delivery to the skin surface during the shaving stroke.

In particular embodiments, each blade includes a substrate of steel and has a layer of strengthening material on the main facets and wedge-shaped edge, the layer of strengthening material being at least twice as hard as the substrate and having a thickness in the range of one thousand to two thousand angstroms from the sharpened tip of the substrate to a distance of forty micrometers from the sharpened tip; and each ultimate tip is defined by tip facets that have lengths of about 0.1–0.2 micrometer and define an included angle of at least 60°. Preferably, the layer of strengthening material is diamond or diamond-like carbon (DLC) material and an adherent polymer coating of shave-facilitating material is on the layer of strengthening material.

Other features and advantages of the invention will be seen as the following description of particular embodiments progresses, in conjunction with the drawings, in which.

DESCRIPTION OF PARTICULAR EMBODIMENTS

Figure 1:
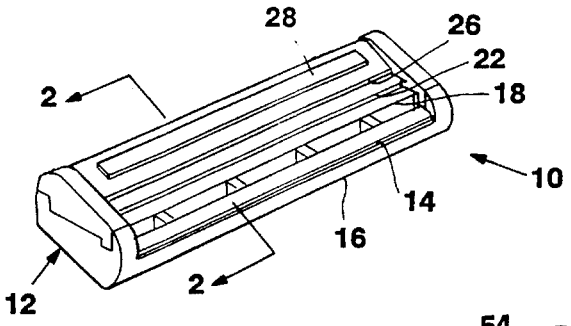
FIG. 1 is a perspective view of a shaving system in accordance with the invention.
Figure 2:
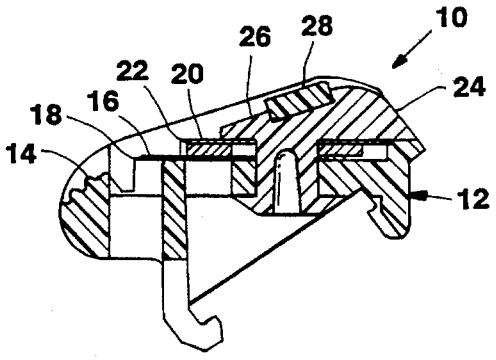
FIG. 2 is a sectional view taken along the line 2—2 of FIG. 1.

The shaving unit 10 shown in FIGS. 1 and 2 is of the type shown in Dorian U.S. Pat. No. 3,786,563 and includes structure for attachment to a razor handle and a platform member 12 molded of high impact polystyrene that includes structure defining forward, transversely extending skin-engaging guard surface 14. Mounted on platform member 12 are leading blade member 16 that has sharpened edge 18 and following blade 20 that has sharpened edge 22. Cap member 24 is of molded high impact polystyrene and has structure defining trailing skin engaging surface 26 that is disposed rearwardly of blade edge 22. Affixed to cap member 24 is shaving aid composite 28.

Figure 3:
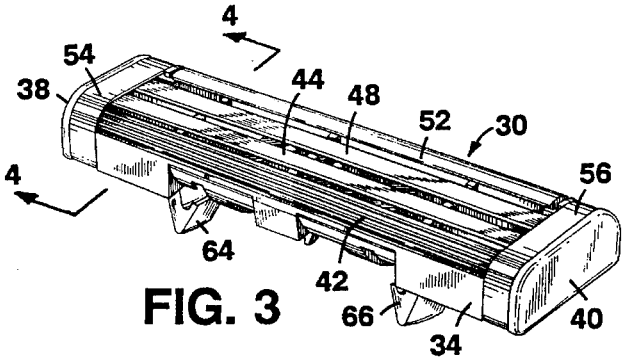
FIG. 3 is a perspective view of another shaving system in accordance with the invention.
Figure 4:
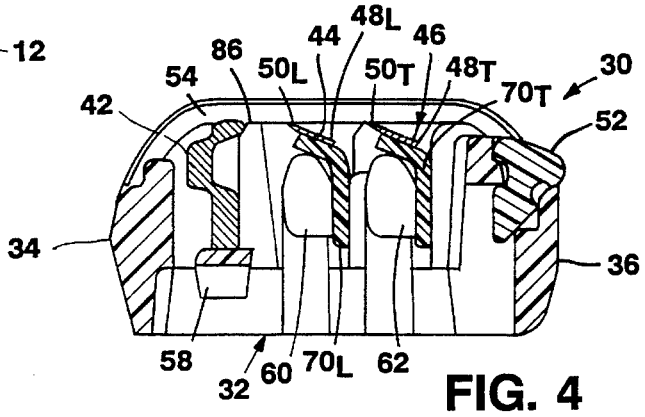
FIG. 4 is a sectional view taken along the line 4—4 of FIG. 3.

The shaving unit 30 shown in FIGS. 3 and 4 is of the type shown in Jacobson U.S. Pat. No. 4,586,255 and includes molded body 32 with front portion 34 rear portion 36, and end wall portions 38, 40. Resiliently secured in body 32 are guard member 42, leading blade unit 44 and trailing blade unit 46. Each blade unit 44, 46 includes a blade member 48 that has a sharpened edge 50. A shaving aid composite 52 is frictionally secured in a recess in rear portion 36.

With reference to the sectional view of FIG. 4, guard member 42 and each blade unit 44, 46 is biased upwardly against metal retaining bands 54, 56 by spring fingers 58, 60, 62 respectively. Shaving unit 30 also includes depending extensions 64, 66, each of which includes an arcuate guard rail surface that engages in pivotal attachment to a razor handle (not shown).

Each blade unit 44, 46 includes a base portion 70 that has a guide portion 72 and a support portion 74 disposed at an angle of about 109° to guide portion 72. Secured to support portion 74 is blade member 48 of the type shown in co-pending application Ser. No. 08/157,747, entitled "Razor Blade Technology" and filed Nov. 24, 1993 and in its parent application Ser. No. 07/792,427, now abandoned.

Figure 5:
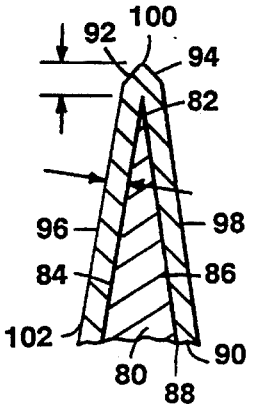
FIG. 5 is a diagrammatic view illustrating one example of razor blade edge geometry in accordance with the invention.

A diagrammatic view of the edge region of the blades 16, 20, 48 is shown in FIG. 5. In one embodiment, the blade includes stainless steel body portion 80 with a wedge-shaped sharpened edge formed in a sequence of mechanical edge forming operations that forms a tip portion 82 that has a radius typically less than 500 angstroms with facets 84 and 86 that diverge at an angle of about 13°. Deposited on tip 82 and facets 84, 86 is interlayer 88 of molybdenum that has a thickness of about 300 angstroms. Deposited on molybdenum interlayer 88 is outer layer 90 of diamond-like carbon (DLC) that has a thickness of about 2,000 angstroms, with facets 92, 94 that have lengths of about one-quarter micrometer each and define an included angle of about 80°, facets 92, 94 merging with main facet surfaces 96, 98 that are disposed at an included angle of about 13° and an aspect ratio (the ratio of the distance (a) from DLC tip 100 to stainless steel tip 82 and the width (b) of the DLC coating 90 at tip 82) of about 1.7. Deposited on layer 90 is an adherent telomer layer 102 that has a substantial as deposited thickness but is reduced to monolayer thickness during initial shaving.

In another embodiment, the blade includes stainless steel body portion 80 with a wedge-shaped sharpened edge formed in a sequence of mechanical edge forming operations that forms a tip portion 82 that has a radius of about 200 angstroms with facets 84 and 86 that diverge at an angle of about 15°. Deposited on tip 82 and facets 84, 86 is interlayer 88 of niobium that has a thickness of about 200 angstroms. Deposited on niobium interlayer 88 is outer layer 90 of diamond-like carbon (DLC) that has a thickness of about 1,400 angstroms, with facets 92, 94 that have lengths of about one-quarter micrometer each and define an included angle of about 65°, facets 92, 94 merging with main facet surfaces 96, 98 that are disposed at an included angle of about 15° and an aspect ratio (the ratio of the distance (a) from DLC tip 100 to stainless steel tip 82 and the width (b) of the DLC coating 90 at tip 82) of about 1.6. Deposited on layer 90 is an adherent telomer layer 102 that has a substantial as deposited thickness but is reduced to monolayer thickness during initial shaving.

Figure 6:
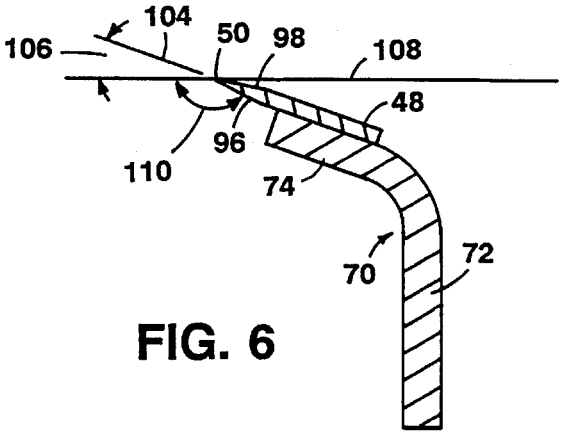
FIG. 6 is an enlarged view of a portion of a blade unit employed in the embodiment shown in FIG. 3 and illustrates certain geometric relationships applicable to the embodiments of FIGS. 1—4.

With reference to FIGS. 5 and 6, the blade 48 has interior facet 96 and exterior facet 98 that define an included angle of about 13° at a distance of forty micrometers from DLC tip 100 in the first embodiment and an included angle of about 15° at a distance of forty micrometers from DLC tip 100 in the second embodiment. In each embodiment, bisector 104 is disposed at a BTA angle 106 of about 19° to reference line 108 that is tangent to the next forward skin-engaging surface (guard 42 in the case of leading blade unit 44 and the edge $\mathbf{50}_L$ of leading blade unit 44 in the case of trailing blade unit 46).

In assembly, the guide portions of guard member 42 are positioned in slots in end walls 38, 40 of body member 32 and biased upwardly against metal retaining bands 54, 56 by spring fingers 58; and blade units 44 and 46 are similarly received in slots in end walls 38, 40 of body member 32 and biased upwardly against metal retaining bands 54, 56 (which define reference line 108) by spring fingers 60, 62, respectively.

The "blade tangent angle" for leading blade unit 44 is the angle 106 between a reference line 104 which bisects the included angle of cutting edge 50 of leading blade unit 44 and a reference line 108 that extends from cutting edge $\mathbf{50}_L$ to a skin-engaging point on guard member 42. Similarly, the "blade tangent angle" for trailing blade unit 46 is the angle 106 between the facet bisector 104 of edge $\mathbf{50}_T$ and a reference line 108 that extends from cutting edge $\mathbf{50}_F$ to cutting edge $\mathbf{50}_L$ of blade unit 44. As guard 42 and both blade units 44 and 46 are biased upwardly against metal retaining bands 50, 52, both reference lines 108 are coincident.

The resulting shaving system is attached to a handle for shaving, and the guard member 42 and blade units 44, 46 move independently of each other against the bias of the spring fingers 58, 60, 62 during shaving while the orientation of the interior facets 96 relative to the shaving plane defined by the reference line 108 and the retaining bands 54, 56 remains substantially constant at an angle 110 of about 154°. The shaving system provides excellent shaving results.

A shaving system of the type shown in FIG. 1 has geometrical relationships that are essentially the same as the geometrical relationships of the system shown in FIG. 3 except that the guard surface 14 and blade edges 18, 22 are in fixed relationship to one another. More specifically, each blade member 16, 20 includes a stainless steel body on which is disposed a DLC layer and a telomer layer. Each blade 16, 20 has an interior facet 84' and an exterior facet 86' that define an included angle of about 13° at a distance of forty micrometers from its tip. The facet bisector 104' is disposed at an angle of about 19° to a reference line 108' that is tangent to the next forward skin-engaging surface (guard 14 in the case of leading blade 16 and the edge 18 of leading blade 16 in the case of trailing blade 20; and the interior main facet 96' of each blade 16, 20 is at an angle of about 154° to its BTA reference line 108'. The shaving system provides excellent shaving results.

While particular embodiments of the invention has been shown and described, various modifications will be apparent to those skilled in the art, and therefore, it is not intended that the invention be limited to the disclosed embodiments, or to details thereof, and departures may be made therefrom within the spirit and scope of the invention.

What is claimed is:

1. A shaving system comprising: body structure, blade structure carried by said body structure, leading skin engaging surface structure carried by said body structure forward of said blade structure, and trailing skin-engaging surface structure disposed rearwardly of said blade structure, said blade structure having a cutting edge of wedge shaped configuration that is defined by interior and exterior main facets with an included facet angle in the range of 10°–17° in the region forty micrometers from said cutting edge, said blade structure including a substrate of steel and having a layer of strengthening material on said main facets and said wedge-shaped edge, said layer of strengthening material being at least twice as hard as said steel substrate and having a thickness of at least one thousand angstroms and said blade structure having an ultimate tip defined by tip facets that have lengths of about 0.1–0.2 micrometer and define an included angle of at least 60°, said blade structure being mounted between said leading and trailing skin-engaging surface structures so that said interior main facet is disposed at an angle of more than 150° to a reference line that extends from said cutting edge of said blade structure to the skin-engaging surface structure next forward of said cutting edge, said blade structure having a bisector bisecting the angle between said interior and exterior main facets and extending away from and passing through said cutting edge, a blade tangent angle of less than 20° being defined between said bisector and said reference line.

2. The system of claim 1 wherein said blade structure includes two blade members with cutting edge disposed parallel to one another and in spaced relation to provide leading and following cutting edges so that both cutting edges are successively active with respect to hair elements being cut during a single shaving stroke.

3. The system of claim 2 wherein said cutting edges are supported in spaced parallel relationship to one another, said leading skin-engaging surface structure includes guard structure disposed forwardly of said cutting edges, and said trailing skin-engaging surface structure includes cap structure disposed rearwardly of said cutting edges.

4. The system of claim 1 wherein said blade structure has a planar body and the bisector of said included facet angle of said cutting edge is parallel to said planar body of said blade structure.

5. A shaving system comprising support structure that defines spaced skin-engaging surfaces, and razor blade structure secured to said support structure, said razor blade structure including a substrate with a wedge-shaped edge defined as the intersection of interior and exterior main facets that have an included angle of less than seventeen degrees at a distance of forty micrometers from the wedge-shaped edge; and a layer of strengthening material on said wedge-shaped edge, said layer of strengthening material having a thickness of at least one thousand angstroms from said wedge-shaped edge to a distance of forty micrometers away from said wedge-shaped edge, said layer of strengthening material having an ultimate tip defined by the intersection of tip facets that have lengths of about 0.1 to 0.2 micrometer and define an included angle of at least sixty degrees, said layer of strengthening material having a hardness of at least twice that of said substrate, said wedge-shaped edge being disposed between said skin-engaging surfaces at a blade tanget angle of less than 20° and said interior main facet being at an angle greater than 150° with respect to a reference line that extends from said ultimate tip to the skin-engaging surface next forward of said ultimate tip.

6. A shaving system comprising support structure that defines spaced skin-engaging surfaces, and razor blade structure secured to said support structure, said razor blade structure including a sharpened tip defined by tip facets that have lengths of about 0.1–0.2 micrometer and define an included angle of at least sixty degrees, and a substrate with a wedge-shaped edge defined by interior and exterior main facets that have an included angle of less than seventeen degrees at a distance of forty micrometers from the wedge-shaped edge, and a layer of strengthening material on said wedge-shaped edge, said layer of strengthening material having a thickness in the range of one thousand to two thousand angstroms from the wedge-shaped edge to a distance of forty micrometers from the wedge-shaped edge, and a hardness of at least twice that of said substrate, said wedge-shaped edge being disposed between said skin-engaging surfaces at a blade tangent angle of less than 20° and said interior main facet being at an angle greater than 150° with respect to its blade tangent angle reference line.

7. The shaving system of claim 6 wherein said razor blade structure includes two said substrates, and the wedge-shaped edges of said two substrates are disposed parallel to one another between said skin-engaging surfaces.

8. The shaving system of claim 7 wherein each said layer of strengthening material is of diamond or diamond-like carbon material; and further including an adherent polymer coating on each said layer of diamond or diamond-like carbon material.

9. The shaving system of claim 6 wherein said substrate is steel; said wedge-shaped edge is formed by a sequence of mechanical abrading steps; and said layer of strengthening material is formed by sputtering.

10. The shaving system of claim 9 wherein said razor blade structure includes two said substrates, and the wedge-shaped edges of said two substrates are disposed parallel to one another between said skin-engaging surfaces.

* * * * *